US005126062A

United States Patent [19]

Barnes

[11] Patent Number: 5,126,062

[45] Date of Patent: Jun. 30, 1992

[54] CALCIUM SULFONATE GREASE AND METHOD OF MANUFACTURE

[75] Inventor: John F. Barnes, Arlington, Tex.

[73] Assignee: NCH Corporation, Irving, Tex.

[21] Appl. No.: 641,468

[22] Filed: Jan. 15, 1991

[51] Int. Cl.[5] ..... C10M 123/02; C10M 141/00

[52] U.S. Cl. ..... 252/18; 252/33.3

[58] Field of Search ..... 252/8, 33.3

[56] References Cited

U.S. PATENT DOCUMENTS

| | | | |
|---|---|---|---|
| 2,967,151 | 1/1961 | Morway | 252/18 |
| 3,655,558 | 4/1972 | Geyer et al. | 252/18 |
| 3,850,823 | 11/1974 | Kjonaas | 252/18 |
| 4,560,489 | 12/1985 | Muir et al. | 252/33.4 |
| 4,597,880 | 7/1986 | Eliades | 252/33.4 |
| 4,728,578 | 3/1988 | Higgins et al. | 252/393 |

*Primary Examiner*—Prince Willis, Jr.
*Assistant Examiner*—Jerry D. Johnson
*Attorney, Agent, or Firm*—Ross, Howison, Clapp & Korn

[57] ABSTRACT

An overbased calcium sulfonate grease comprising neutral oil, calcium sulfonate, calcium carbonate, dodecyl benzyl sulfonic acid, isopropyl alcohol, water, calcium hydroxide, 12-hydroxy stearic acid, phosphoric acid and an antioxidant.

20 Claims, No Drawings

CALCIUM SULFONATE GREASE AND METHOD OF MANUFACTURE

BACKGROUND OF THE INVENTION

1. Field of the Invention

This invention relates to greases, and more particularly, to an overbased calcium sulfonate grease having improved physical properties.

2. Description of the Prior Art

Overbased greases are well known in the art, and are characterized by a metal content in excess of that which would be present according to the stoichiometry of the metal and the particular organic compound reacted with the metal, for example, a carboxylic or sulfonic acid. Various processes are disclosed in the prior art which are useful for making a product containing more than the stoichiometic amount of metal. Following these procedures, the sulfonic acid or an alkali or alkaline earth metal salt thereof can be reacted with a metal base and the product will contain an amount of metal in excess of that necessary to neutralize the acid. The actual stoichiometic excess of metal can vary considerably, for example, from about 0.01 equivalent to about 30 or more equivalents, depending on the reactions, process conditions, and the like.

Prior art greases and lubricants are disclosed, for example, in the following U.S. Pat. Nos.: 2,977,301; 2,978,410; 3,186,944; 3,242,079; 3,376,222; 3,492,231; 3,907,691; 3,929,650; 4,376,060; 4,560,489; 4,597,880; and 4,824,584.

U.S. Pat. No. 4,560,489 discloses greases comprising a combination of (1) a highly overbased calcium sulfonate of a high molecular weight oil-soluble sulfonic acid, dissolved in an oil, containing extremely finely divided calcium carbonate; and (2) a product formed by the reaction of boric acid with a calcium compound such as calcium hydroxide or calcium oxide; and (3) a product formed from calcium hydroxide/calcium oxide and a soap-forming aliphatic monocarboxylic or fatty acid.

In making overbased greases, conversion agents are used to convert the Newtonian homogeneous, single-phase overbased materials into non-Newtonian colloidal disperse systems. U.S. Pat. No. 3,492,231 discloses the use of phosphorous acids as conversion agents in forming colloidal disperse systems.

SUMMARY OF THE INVENTION

According to the present invention, an overbased calcium sulfonate complex grease is provided that demonstrates excellent physical properties without requiring calcium borate modification as disclosed in U.S. Pat. No. 4,560,489.

The greases of the invention preferably comprise mined and ground calcium carbonate having a maximum particle size less than about 20 microns and a quartz content less than about 0.05 percent. The use of mined and ground calcium carbonate in the compositions of the invention is particularly advantageous as compared to calcium sulfonate greases in which the calcium carbonate is formed in situ. The use of ground calcium carbonate eliminates the need for a pressurized kettle, greatly simplifies the process of making the grease, and avoids the necessity of repeatedly checking the alkalinity of the mixture during preparation.

According to a preferred embodiment of the invention, the calcium sulfonate grease disclosed herein comprises solvent neutral oil, calcium sulfonate, calcium carbonate, dodecyl benzyl sulfonic acid, isopropyl alcohol, water, calcium hydroxide, 12-hydroxy stearic acid, phosphoric acid and an antioxidant.

According to a particularly preferred embodiment of the invention, the subject composition comprises from about 22.5 to about 32.5 weight percent solvent neutral oil, from about 66.0 to about 47.4 weight percent calcium sulfonate, from about 5 to about 15 weight percent calcium carbonate having a maximum particle size less than about 20 microns and a quartz content less than about 0.05 percent, from about 1.10 to about 1.50 weight percent dodecyl benzyl sulfonic acid, from about 2.50 to about 3.50 weight percent isopropyl alcohol, from about 3.00 to about 6.00 weight percent water, from about 2 to about 4 weight percent 12-hydroxy stearic acid, from about 1.75 to about 2.25 weight percent phosphoric acid, and a minor effective amount of an antioxidant.

The use of dodecyl benzyl sulfonic acid and phosphoric acid in the compositions of the invention is found to contribute significantly to high temperature characteristics, anti-wear and extreme pressure properties of the subject greases. More particularly, the greases disclosed herein are found to have a significantly higher dropping point than the overbased calcium sulfonate greases disclosed in the prior art.

DESCRIPTION OF THE PREFERRED EMBODIMENTS

The compositions of the invention are preferably made by blending the neutral oil, calcium sulfonate and calcium carbonate in an open kettle while heating to a temperature range of from about 150° to about 200° F. (66° to 93° C.). A steam-jacketed kettle having double acting paddles is satisfactory for use in blending these components. Although 600 solvent neutral oil is preferred for use in the compositions of the invention, it will be appreciated by those of ordinary skill in the art that other similar oils can also be used and that lighter oils can be used where better improved low temperature properties are desired.

A preferred calcium sulfonate for use in the compositions of the invention is a 400TBN. If desired, 300TBN calcium sulfonate can be substituted, but more is required, or else more calcium hydroxide is needed to provide enough calcium to react with the other components of the composition.

The preferred calcium carbonate for use in the grease disclosed herein is a natural mined material that is ground to a powder having a maximum particle size less than about 20 microns, and most preferably, to an average particle size of about 10 microns. Although coarser grinds of mined calcium carbonate are generally less expensive, particle sizes greater than about 20 microns may tend to clump during wear rather than remaining evenly distributed throughout the grease. Because the preferred calcium carbonate for use in the invention is naturally occurring, it may contain minor amounts of quartz, and preferably will contain less than about 0.05 percent quartz by weight. Although precipitated or formed calcium carbonate can be substituted in the composition of the invention, the use of calcium carbonate formed in situ is preferably avoided.

According to a preferred embodiment of the invention, the grease as disclosed herein will comprise from about 22.5 to about 32.5 weight percent neutral oil, from about 36.0 to about 47.4 weight percent calcium sulfonate, and from about 5 to about 15 weight percent calcium carbonate. As used herein, all weight percents are noted as percentages of the weight of the final product.

After the blend is prepared as described above, isopropyl alcohol, water and dodecyl benzyl sulfonic acid are preferably added to the mixture. The compositions of the invention preferably comprise from about 2.50 to about 3.50 weight percent isopropyl alcohol, from about 3.00 to about 6.00 weight percent water, and from about 1.10 to about 1.50 weight percent dodecyl benzyl sulfonic acid. The isopropyl alcohol and water are desirably added to promote gelling. When added to the mixture, the water is preferably at ambient temperature. After adding the alcohol, water and sulfonic acid, the mixture is preferably heated to a temperature ranging from about 220 to about 230° F. (104° to 110° C.) and held while stirring for a period ranging from about 30 minutes to about one hour, depending upon atmospheric conditions. Within this time, the blended mixture should gel to form a grease. If the mixture is held at too low a temperature, the gelling process takes too long. Conversely, if the mixture becomes too hot, the isopropyl alcohol will boil off prematurely.

The use of dodecyl benzyl sulfonic acid in the compositions of the invention is believed to be important for achieving adequate dispersion of the calcium carbonate throughout the grease.

Once gelling has occurred, calcium hydroxide is preferably added in an amount ranging from about 1.90 to about 2.70 weight percent of the final product, and the material is further heated to about 240° F. (116° C.). The calcium hydroxide component is needed to provide enough extra alkalinity so that acids can be added for the final gel while maintaining an alkaline finished product. An alkaline finished product is desirable in order to promote storage stability, lengthen the working life of the finished grease, and avoid the corrosive effects of acids that may be formed during wear.

Following addition of the calcium hydroxide, the 12-hydroxy stearic acid and phosphoric acid components are preferably slowly added sequentially. Slow addition of the stearic acid and phosphoric acid components is desired in order to minimize foaming that might otherwise occur due to the presence of water in the system. The 12-hydroxy stearic acid is mixed for about 20 minutes. After the 12-hydroxy stearic acid is added and permitted to react, the phosphoric acid is slowly added and also mixed for about 20 minutes.

Phosphoric acid is a stronger acid and better scavenger than the relatively weaker organic acid, and is therefore added last. The use of phosphoric acid in the greases of the invention is believed to contribute to the enhanced physical properties observed with the subject greases. The use of organic acids alone yields greases that lack the desirable high temperature properties.

According to a preferred embodiment of the invention, the amount of 12-hydroxy stearic acid used in the subject greases ranges from about 2 to about 4 weight percent, and most preferably about 3 weight percent, by weight of the finished product. The use of 12-hydroxy stearic acid is preferred in the compositions of the invention for its contribution to the work stability of the resultant grease, the ease with which it can be mixed into the other components, and its wide general availability and relatively inexpensive costs. Greases comprising less than about 2 weight percent of the 12-hydroxy stearic acid may lack the desired long term stability, and the use of more than about 4 weight percent is not cost effective. It will be appreciated, however, by those of ordinary skill in the art, that the amount of 12-hydroxy stearic acid utilized in the compositions of the invention can vary depending upon the amount of calcium carbonate that is present.

Similarly, the amount of phosphoric acid used in preparing the subject greases depends upon the amount of calcium hydroxide used so that the desired physical properties are achieved while the final product remains alkaline. According to a particularly preferred embodiment of the invention, the amount of phosphoric acid used in preparing the subject calcium sulfonate greases will range from about 1.75 weight percent to about 2.25 weight percent where the amount of calcium hydroxide ranges from about 1.90 weight percent to about 2.70 weight percent. As used herein, "phosphoric acid" refers to an aqueous solution of ortho-phosphoric acid having a concentration of about 75% by weight.

Alternatively, it is believed that lesser amounts of relatively stronger inorganic acids, such as, for example, sulfuric or nitric acid, can also be used to produce satisfactory overbased calcium sulfonate greases in a similar manner.

According to a particularly preferred embodiment of the invention, from about 0.15 to about 0.40 weight percent glacial acetic acid is added to the mixture and mixed for about 20 minutes prior to addition of the 12-hydroxy stearic acid. The prior addition and mixing of acetic acid will permit it to react before the 12-hydroxy stearic acid is added. Although 20 minutes is not viewed as a critical mixing time, it is believed to be a satisfactory mixing time when preparing an 8,000 pound batch in a blending kettle as described above.

While glacial acetic acid is preferred for use in making the greases of the invention, preferably in an amount ranging from about 0.15 to about 0.40 weight percent, it should be understood that greases falling within the scope of the invention can also be produced without the use of acetic acid.

Following addition of the above-mentioned acid components, the grease is preferably heated to a temperature range between about 250° and 300° F. (121° C. to 149° C.), at which time from about 0.50 to about 3.50 weight percent of polystyrene isoprene added to improve the properties of the final grease. According to a particularly preferred embodiment of the invention, the polystyrene isoprene is added in the form of a crumb polymer. Following addition of the polystyrene isoprene, the mixture is preferably heated to a temperature ranging from about 320° to 330° F. (160° to 166° C.) and cooked for about one hour, then allowed to cool.

When the resultant grease has cooled to a temperature under about 200° F. (93° C.), a mid-to-high range antioxidant such as Vanlube PNA is preferably added to the mixture. At this time, other additives such as dispersants, tackifiers, and the like, can be mixed into the final composition, preferably mixing for up to about an hour to ensure thorough dispersion.

The overbased calcium sulfonate grease of the invention and the physical properties achieved thereby are further described and explained in relation to the following example:

EXAMPLE 1

In a steam-jacketed, open kettle having doubleacting paddles, 27.55 weight percent neutral oil, 41.44 weight percent 400TBN calcium sulfonate and 7.89 weight percent calcium carbonate are blended while heating to a temperature of 150° F. (66° C.). To this blend, 3.16 weight percent isopropyl alcohol, 4.74 weight percent water and 1.3 weight percent dodecyl benzyl sulfonic acid are added, and the resultant mixture is heated to about 225° F. (107° C.) and stirred for about an hour, during which time gelling occurs. About 2.29 weight percent calcium hydroxide is then added and the mixture is heated to 240° F. (116° C.). About 0.3I weight percent glacial acetic acid is added slowly and mixed for about 20 minutes, followed by the slow addition of 2.96 weight percent 12-hydroxy stearic acid and 1.97 weight percent phosphoric acid, with each acid addition being followed by about 20 minutes of mixing. The resultant grease is heated to about 250° F. (121° C.) and 1.26 weight percent polystyrene isoprene is added in the form of a crumb polymer. Following addition of the polystyrene isoprene, the grease is heated to about 325° F. (163° C.), cooked for one hour, then allowed to cool overnight. The penetration of the resultant grease is about 260 pen.

When the grease is cooled to about 200° F. (93° C.), 1.97 weight percent Vanlube PNA, 2.96 weight percent of 50% Moly Graph dispersant, and 0.2 weight percent Paratac are added and mixed for one hour. A final test shows a penetration of about 280 pen.

The subject grease is found to have a dropping point greater than about 600, a much higher dropping point than is observed in the calcium borate-modified overbased calcium sulfonate complex greases as disclosed in U.S. Pat. No. 4,560,489. Additionally, less than 3 percent loss is experienced when the grease of the invention is used in a conventional wheel bearing test, (ASTM D1267) as compared to a loss of about 8 percent for calcium borate-modified overbased calcium sulfonate greases.

Other alterations and modifications of the invention disclosed herein will become apparent to those of ordinary skill in the art upon reading the present disclosure, and it is intended that the scope of the invention be limited only by the broadest interpretation of the appended claims to which the inventor is legally entitled.

I claim:

1. A calcium sulfonate grease comprising neutral oil, calcium sulfonate, calcium carbonate, dodecyl benzyl sulfonic acid, isopropyl alcohol, water, calcium hydroxide, 12-hydroxy stearic acid, phosphoric acid and an antioxidant;

wherein said grease comprises from about 36.0 to about 47.4 weight percent calcium sulfonate, from about 5 to about 15 weight percent calcium carbonate, and from about 1.10 to about 1.50 weight percent dodecyl benzyl sulfonic acid.

2. The grease of claim 1 wherein said calcium carbonate is ground.

3. The grease of claim 1 wherein said calcium carbonate is precipitated.

4. The grease of claim 1 comprising about 8 weight percent calcium carbonate.

5. The grease of claim 1 wherein said calcium carbonate has a maximum particle size of about 20 microns.

6. The grease of claim 1 wherein said calcium carbonate has an average particle size of about 10 microns.

7. The grease of claim 1 wherein said calcium carbonate comprises less than about 0.05 weight percent quartz.

8. The grease of claim 1 comprising from about 2 to about 4 weight percent 12-hydroxy stearic acid.

9. The grease of claim 8 comprising about 3 weight percent 12-hydroxy stearic acid.

10. The grease of claim 1 comprising from about 2.50 to about 3.50 weight percent isopropyl alcohol.

11. The grease of claim 1 comprising from about 1.90 to about 2.75 weight percent calcium hydroxide.

12. The grease of claim 1 comprising from about 3.00 to about 6.00 weight percent water.

13. The grease of claim 1 comprising from about 0.10 to about 5.00 weight percent of an antioxidant.

14. The grease of claim 1 further comprising from about 0.25 to about 8.4 weight percent glacial acetic acid.

15. The grease of claim 1 further comprising from about 0.50 to about 3.50 weight percent polystyrene isoprene.

16. An overbased calcium sulfonate grease comprising from about 22.5 to about 32.5 weight percent solvent neutral oil, from about 36 to about 47.4 weight percent calcium sulfonate, from about 5 to about 15 weight percent calcium carbonate having a maximum particle size less than about 20 microns and a quartz content less than about 0.05 percent, from about 1 to about 1.5 weight percent dodecyl benzyl sulfonic acid, from about 2.5 to about 3.5 weight percent isopropyl alcohol, from about 3 to about 6 weight percent water, from about 2 to about 4 weight percent 12-hydroxy stearic acid, from about 1.75 to about 2.25 weight percent phosphoric acid, and a minor effective amount of an antioxidant.

17. A method for making an overbased calcium sulfonate grease comprising the steps of:

a. blending from about 22.5 to about 32.5 weight percent solvent neutral oil, from about 36 to about 47.4 weight percent calcium sulfonate, from about 5 to about 15 weight percent calcium carbonate in an open kettle while heating to a temperature range of from about 150° F. (66° C.) to about 200° F. (93° C.);

b. adding to the blend from about 2.5 to about 3.5 weight percent isopropyl alcohol, from about 3 to about 6 weight percent water, and from about 1.1 to about 1.5 weight percent dodecyl benzyl sulfonic acid;

c. heating the mixture thus formed to a temperature ranging from about 220° F. (104° C.) to about 230° F. (110° C.), and holding the mixture at that temperature while stirring for a period ranging from about 30 minutes to about 1 hour to cause gelling;

d. after gelling, adding calcium hydroxide in an amount ranging from about 1.9 to about 2.7 weight percent of the grease;

e. heating the material thus produced to a temperature of about 240° F. (116° C.).

f. slowly adding from about 2 to about 4 weight percent 12-hydroxy stearic acid and mixing for about 20 minutes; and g. thereafter slowly adding from about 1.75 to about 2.25 weight percent phosphoric acid and mixing for about 20 minutes.

18. The method of claim 17, further comprising the step of adding from about 0.15 to about 0.4 weight percent glacial acetic acid and mixing for about 20 minutes prior to the addition of the 12-hydroxy stearic acid.

19. The method of claim 17, comprising the additional steps of heating the grease to a temperature ranging from about 250° F. (121° C.) to about 300° F. (149° C.), adding thereto from about 0.5 to about 3.5 weight percent polystyrene isoprene, heating to a temperature ranging from about 320° F. (160° C.) to about 330° F. (166° C.), and cooking at that temperature for about 1 hour.

20. The method of claim 19, comprising the additional steps of cooling the grease to a temperature under about 200° F. (93° C.), adding an antioxidant, and thereafter mixing to achieve thorough dispersion.

* * * * *

UNITED STATES PATENT AND TRADEMARK OFFICE

CERTIFICATE OF CORRECTION

PATENT NO. : 5,126,062

DATED : JUNE 30, 1992

INVENTOR(S) : JOHN F. BARNES

It is certified that error appears in the above-identified patent and that said Letters Patent is hereby corrected as shown below:

COLUMN 2, LINE 7:

Delete [66.0] and insert --36.0--.

Signed and Sealed this

Thirty-first Day of August, 1993

Bruce Lehman

*Attest:*

BRUCE LEHMAN

*Attesting Officer*

*Commissioner of Patents and Trademarks*